United States Patent [19]

Derman

[11] Patent Number: 5,001,854

[45] Date of Patent: Mar. 26, 1991

[54] GUN SAFETY LOCKING DEVICES

[76] Inventor: Jay S. Derman, 1201 N. Catalina Ave., Redondo Beach, Calif. 90277-0949

[21] Appl. No.: 562,214

[22] Filed: Aug. 3, 1990

[51] Int. Cl.[5] ..... F41A 17/04

[52] U.S. Cl. ..... 42/70.11

[58] Field of Search ..... 42/70.11

[56] References Cited

U.S. PATENT DOCUMENTS

| | | | |
|---|---|---|---|
| 2,327,334 | 8/1943 | Parker | 42/70.11 |
| 2,479,107 | 8/1949 | Garretson | 42/70.11 |
| 2,887,807 | 5/1959 | Santangelo | 42/70.11 |
| 3,022,598 | 2/1962 | Wikstrom | 42/70.11 |
| 3,137,957 | 6/1964 | Ingalls | 42/70.11 |
| 3,768,189 | 10/1973 | Goodrich | 42/70.11 |
| 4,398,366 | 8/1983 | Wernicki | 42/70.11 |
| 4,479,320 | 10/1984 | Fix | 42/70.11 |
| 4,512,099 | 4/1985 | Mathew | 42/70.11 |
| 4,969,284 | 11/1990 | Healey et al. | 42/70.11 |

*Primary Examiner*—Deborah L. Kyle
*Assistant Examiner*—Richard W. Wendtland
*Attorney, Agent, or Firm*—Monty Koslover Assoc.

[57] ABSTRACT

A safety device for locking a rifle, pistol or revolver so that it can not be accidentally discharged. The device operates by occupying the barrel of the gun and projecting into the breech. It is locked in place by a digital padlock which is used because it is difficult for children and unauthorized persons to open while being easy for an authorized person to open in the dark. Use of the device requires removal or displacement of parts of the weapon, increasing the safety provisions and guarding against accidental firing.

3 Claims, 1 Drawing Sheet

GUN SAFETY LOCKING DEVICES

BACKGROUND OF THE INVENTION

This invention relates to safety accessories for hand guns and rifles of all types, which act to prevent accidental or unauthorized firing of the weapon.

With the large number of hand guns and rifles presently in the possession of the general public, it is common to hear of accidental firing of a weapon, both by children and by adults. Many of these accidents result in death or severe injury to the handler or a bystander. Particularly in the case of children playing with the weapon, these accidents could not occur if the gun in question was locked in a manner to prevent firing.

With regard to adult use, it should be necessary to first remove the locking device and then have to set up the gun for firing, including loading. Thus, accidental firing would be far less likely.

Presently available gun locking devices are designed to lock the gun trigger in place using a lock and key, preventing it from being pulled and firing the gun. The gun may otherwise be ready for firing, and might possibly be loaded. Usually, unlocking the device with a key is all it takes to be able to fire the weapon. It, therefore, is an object of this invention to provide a gun safety locking device that does not require use of a key and will prevent accidental firing of the weapon. As a condition of using the invention, it will require setting up the gun before it is ready to be fired.

BRIEF SUMMARY OF THE INVENTION

The device can be used to lock an automatic pistol, a revolver or a rifle. It comprises an elongated tube assembly which has a spring-loaded actuating.rod inside it, and a digital type padlock. The tube assembly is inserted in the gun barrel until an end protrudes into the gun breech. Fully depressing the actuating rod causes a ball to pop up through a hole near the tube end which projects into the gun breech, preventing removal of the tube assembly. The digital padlock is applied to the end of the tube assembly which protrudes from the gun muzzle, locking the actuating rod and the tube assembly in place.

To use the above invention, the magazines would have had to be removed from the rifle or pistol, and the revolver chamber, would have had to be moved aside to the open position. Thus, the gun operator is protected from inadvertent gun discharge, because of the need to reconfigure or set up the gun after removal of the locking device.

DESCRIPTION OF THE PREFERRED EMBODIMENTS

Figure 1:
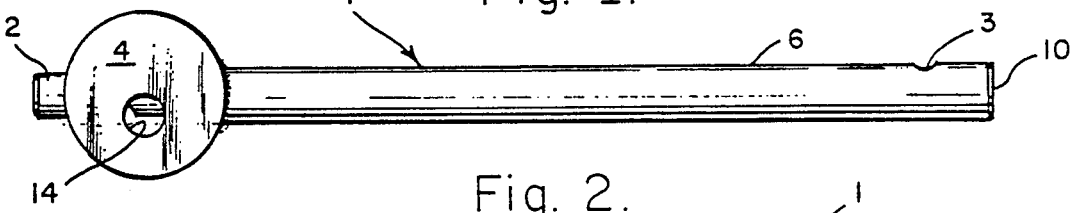
FIG. 1 is a side view of the gun locking device of the present invention.
Figure 2:
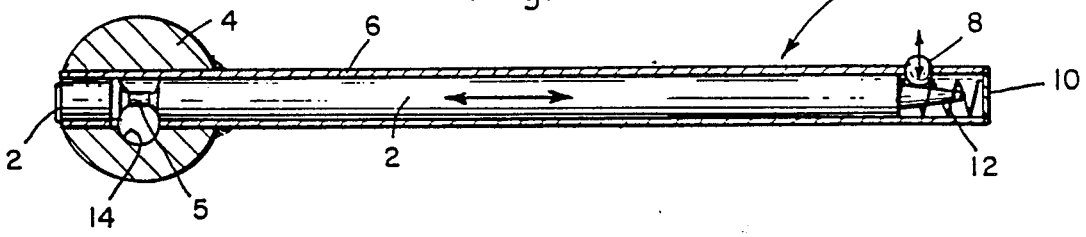
FIG. 2 is a longitudinal cut-away view of the gun locking device, particularly showing the action of the actuating rod and ball which are located inside the tube member.

Referring now particularly to the drawings, there is shown in FIG. 1 a side view of the gun lock device 1. FIG. 2 is a cut-away side view of the device, showing its operation. The device comprises a block piece 4, an actuating rod 2, an elongated tube member 6, a metal ball 8, a spring 12 and a digitally operated padlock 15. The tube member 6 is sized to fit in the barrel of a pistol, revolver or rifle, and its length is made sufficient to protrude into the gun breech while extending beyond the gun muzzle. Thus, there are several tube member diameter sizes and lengths, depending on the weapon bore and type.

The tube member 6 is constructed of a rigid metal such as brass or aluminum and has one end open and the other closed by a cap 10. A first hole 3 is located in the surface of the tube member 6 near to its closed end. This hole 3 is made initially large enough to allow the ball 8 to be inserted, and it is then swaged to narrow the hole diameter, allowing the ball 8 to protrude through while retaining it. The open end of the tube member 6 is assembled to the cylindrical block piece 4, by insertion in a first hole bored through the block piece 4 and then fixedly secured by welding or brazing.

The actuating rod 2 is made of a rigid metal and is sized for insertion in the tube member 6 and to fully occupy the length of the tube member 6. In order to do this, it must be pressed to compress a spring 12 which has been previously placed inside the tube member 6 at its closed end. A tapered surface is formed at the end of the actuating rod 2 that is inserted in the tube member. This tapered surface fits into the spring 12, and forces the ball 8 outwards through the tube member 6 when the actuating rod is pushed in.

A retaining means for the actuating rod 2 is provided, allowing it to be locked in the depressed (actuated) position. In this embodiment, the retaining means takes the form of including a groove 5 which is cut around the rod 2 circumference, and located on the rod 2 to coincide with a second hole 14 that is cut through the block piece 4. When the actuating rod 2 is depressed, the groove 5 lines up with the second hole 14 in the block 4. A padlock 15 arm may be then inserted in the hole 14, and bearing against the groove 5 in the rod 2, retains it and locks it in place.

Figure 3:
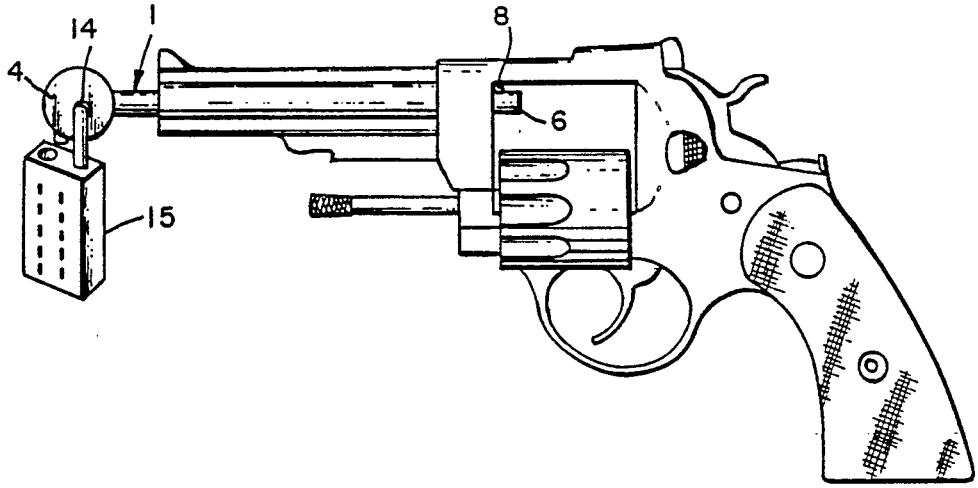
FIG. 3 shows the gun locking device being used to lock a revolver and being secured by a digitally operated padlock.

As shown in FIG. 3, the device 1 is placed in the barrel of a revolver until the end of the tube member 6 protrudes into the breech. The rod 2 is depressed to actuate the ball 8 forcing it outwards so that it protrudes into the breech and prevents removal of the tube member 6. A digitally operated padlock 15, whose arm is placed through the hole 14 in the block 4, locks the rod 2 and the device 1 in place. It will be observed that the revolver bullet chamber has to be rotated outward to permit the device 1 to be inserted. Similarly, if the device is used in an automatic pistol or a rifle, the magazines would have to be removed first. Thus, the weapon can not be immediately fired upon withdrawal of the locking device 1, and needs to have its magazine replaced, ruling out accidental firing. A further safety feature is the recommended use of a digitally operated padlock 15 rather than the more common key or combination operated padlock. Keys may be lost or fall into the wrong hands. A digitally operated padlock is more difficult for unauthorized people and children to open than the key type padlock, because a series of numbers must be memorized. It is also easy for an authorized person to open in the dark, when needed, avoiding the fumbling for a key or trying to view a rotating dial. For all these reasons, a digitally operated padlock is recommended with the gun locking devices.

The foregoing gun locking device described herein is characterized by requiring a partial disassembly of the weapon in order to use the device as a gun lock. This is believed to be a considerable safety feature, mitigating against the possibility of accidental gun discharge by children or by any user, even after removal of the padlock and the device.

Various changes and modifications may be made in the construction of the locking devices described above. These changes, which are in accord with the spirit of this invention, are considered to be within the scope of the appended claims and are embraced thereby.

What is claimed is:

1. A gun locking device comprising:

an elongated tube member, sized to fit in the barrel of an automatic pistol, revolver or rifle; said tube member having one open end and the other end closed by a cap;

a block piece, having a first hole bored through it, and fixedly secured to the open end of said tube member so that said first hole lines up with the inside diameter of said tube member;

a metal ball, for insertion in said tube member at near its closed end;

a spring, for insertion in said tube member and placing at its closed end;

an actuating rod, sized to be inserted in and fully occupy said tube member, bearing against said spring; and a padlock for securing to said block piece, said padlock preferably being digitally operated for maximum security and ease of operation;

said actuating rod having a tapered surface at one end and a retaining means at near its distal end; said tapered surface shaped to force said ball upwards when said rod is fully inserted in said tubular member; said tube member having a first hole in its surface, located near its closed end, said first hole being large enough to allow said ball to protrude partially through said hole while retaining it;

said block piece having a second hole bored through its plane surface, perpendicular to said first hole and located to coincide and partially intersect said first hole diameter;

said elongated tube member and block with said actuating rod assembled, being inserted in the barrel of a gun until the closed end of said tube member extends into the gun breech, and said ball protrudes through said tube member sufficient to interfere with the gun bore and prevent removal of said tube member; said padlock having its arm inserted through said second hole of said block piece, preventing said rod from being withdrawn and locking it in place, thus preventing the unauthorized or accidental firing of the gun.

2. The gun locking device of claim 1 wherein:

said elongated tube member has a length which is made sufficient to occupy the full length of a gun barrel of an automatic pistol, revolver or rifle, as selected.

3. The gun locking device of claim 1 wherein:

said actuating rod retaining means includes a groove which is cut into said rod circumference; said groove being located on said rod to coincide with said second hole in said block piece and enable engagement with said padlock arm when said rod is fully inserted through said block piece and through said tube member, compressing said spring.

* * * * *